United States Patent [19]

Smith

[11] Patent Number: 4,697,849

[45] Date of Patent: Oct. 6, 1987

[54] CHILD'S HIGH CHAIR RESTRAINING DEVICE

[76] Inventor: Suzann Smith, 8483 Holly, Canton, Mich. 48187

[21] Appl. No.: 412

[22] Filed: Jan. 5, 1987

Related U.S. Application Data

[63] Continuation of Ser. No. 737,323, May 23, 1985, abandoned.

[51] Int. Cl.[4] ..... A62B 35/00

[52] U.S. Cl. ..... 297/485; 297/466; 24/306

[58] Field of Search ..... 24/298, 301, 306; 297/485, 466, 468, 484; 280/33.99 B

[56] References Cited

U.S. PATENT DOCUMENTS

| | | | |
|---|---|---|---|
| 2,407,646 | 9/1946 | Best . | |
| 2,610,670 | 9/1952 | Grooms . | |
| 2,862,246 | 3/1958 | Adams et al. . | |
| 3,947,927 | 4/1976 | Rosenthal | 24/298 X |
| 4,550,800 | 11/1985 | Dietrich | 280/33.99 B |
| 4,618,186 | 10/1986 | Swanson | 297/485 X |
| 4,637,622 | 1/1987 | Burgard | 297/485 X |

*Primary Examiner*—Peter A. Aschenbrenner
*Assistant Examiner*—Laurie K. Cranmer
*Attorney, Agent, or Firm*—Charles W. Chandler

[57] ABSTRACT

A restraining device for a child's high chair includes a pair of straps, each having buckle means at one end for encircling the child's thigh, and hook and loop means at the opposite end for releasably encircling an upright tubular frame member on the back of the high chair.

2 Claims, 3 Drawing Figures

CHILD'S HIGH CHAIR RESTRAINING DEVICE

This application is a continuation of application Ser. No. 737,323, filed May 23, 1985, now abandoned.

BACKGROUND OF THE INVENTION

This invention is related to strap devices for preventing a child from slipping off the seat of a high chair, and more particularly to a pair of straps for connecting the thigh of each leg of the child to the back supporting frame of the high chair.

Infants placed in high chairs frequently tend to slide under the tray and off the chair. This can be dangerous, particularly when the infant's head gets caught on the tray. Various devices are employed to prevent the infant from sliding off the seat, such as mounting a band at the front of the seat which has a pair of openings for receiving the infant's legs. This is illustrated in U.S. Pat. No. 2,826,246 which issued to D. E. Adams et al, Mar. 11, 1958. It is obviously difficult to insert and remove squirming infant's legs through such openings.

In other cases, straps have been used for connecting the infant's ankles to the chair beneath the seat. The straps, of course, provide only a minimal protection from the infant sliding under the tray. This art is illustrated in U.S. Pat. No. 2,407,646 which issued to J. W. Best, Sept. 17, 1946 and U.S. Pat. No. 2,610,670 which issued to P. E. Grooms, Sept. 16, 1952.

SUMMARY OF THE INVENTION

The broad purpose of the present invention is to provide a pair of straps for connecting the infant's legs to the high chair back frame structure. The preferred embodiment of the invention employs two nylon straps. Each strap has a buckle and tongue arranged to snap around the upper portion of the child's leg. The opposite end of each strap has a hook and loop fastener means that can be quickly attached to the vertical tubular support found on the back of most modern high chairs.

The advantage of such an arrangement is that the straps can be quickly connected to the infant. They prevent the infant from sliding under the tray. They do not annoy the infant, and they can be readily cleaned and easily manufactured.

Still further objects and advantages of the invention will become readily apparent to those skilled in the art to which the invention pertains upon reference to the following description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
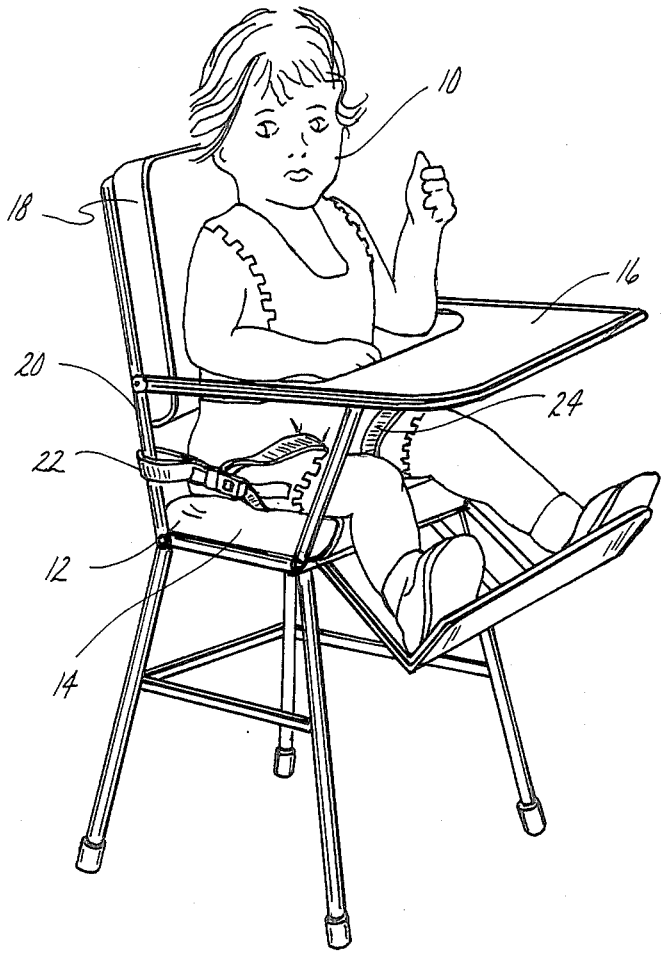
FIG. 1 is a perspective view illustrating an infant in a high chair connected by straps illustrating the preferred embodiment of the invention.

Referring to the drawing, an infant 10 is illustrated mounted in a conventional high chair 12 having a seat 14 on which the infant is placed. The high chair has conventional tray 16 at the forward end of the seat, and a back supporting frame 18 at the rearward end of the seat. The back supporting frame includes a U-shaped tubular leg 20 connected on opposite sides of the seat.

A pair of strap means 22 and 24 connect the infant to the seat to prevent him from sliding off the seat. The two straps are identical, strap 22 being connected to the upper portion of the infant's right leg and strap 24 being connected to the upper portion of the infant's left leg.

Figure 2:
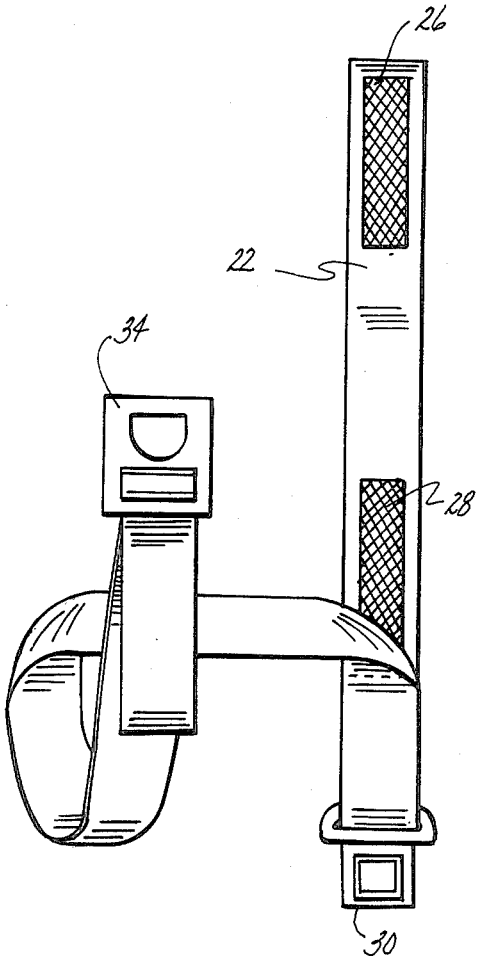
FIG. 2 is a view illustrating one of these straps.
Figure 3:
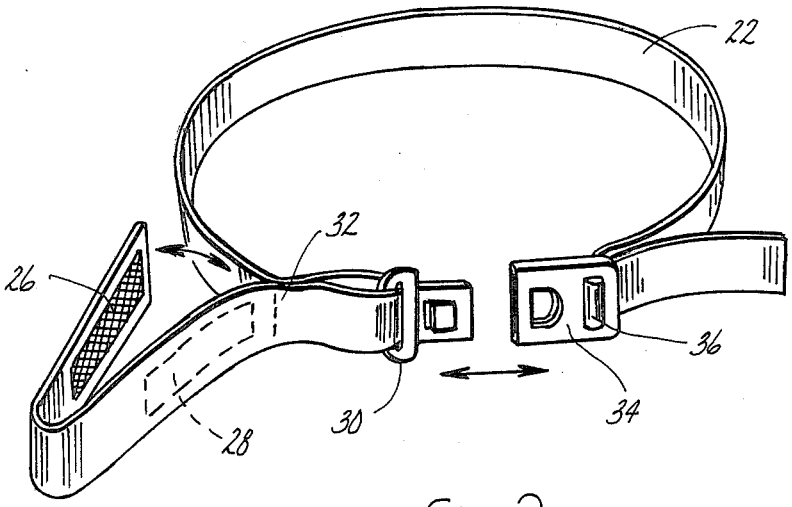
FIG. 3 is another view illustrating the manner in which the loops are formed in the opposite ends of the strap.

FIG. 2 illustrates strap 22 which is preferrably a one inch wide elongated element formed on nylon so as to be easily washable. A pair of complementary Velcro fastener hook means 26 and loop means 28 are attached to Velcro fastener means 26 and 28 and spaced sufficiently so that the end of the strap can readily encircle leg 22 of the back supporting frame.

A plastic tongue 30 is mounted on the strap which is then stitched at 32 to retain the tongue in position. A plastic buckle 34 is connected by slideable loop 36 to the opposite end of the strap. The tongue is engageable with the buckle, however, it is to be understood that other forms of releasable fasteners can be employed. The position of the buckle is adjustable on the strap to accommodate the circumference of the upper portion of the child's leg, that is, the thigh area.

In use, the two straps are normally connected to opposite legs of the back supporting structure by the Velcro means. When the child is placed in the seat each strap is then buckled around his upper thigh as illustrated in FIG. 1. The two straps cooperate in preventing the child from slipping from his seated position toward the tray.

Having described my invention, I claim:

1. A restraint for use with a child's high chair having a back supporting frame, and a seat for supporting a child having a first leg and a second leg, comprising:

a one-piece, continuous, elongated first strap having a first end and a second end, and stitch means intermediate said ends forming a first loop in the first strap;

a pair of cooperating buckle elements mounted on the first strap, the buckle elements including a buckle tongue, and a buckle housing for releasably receiving the tongue, one of said buckle elements having opening means receiving the first strap loop, the other of said buckle elements being mounted on the first strap between the first loop and the first end of the first strap, the buckle tongue being engageable with the buckle housing to form a second loop in the first strap for embracing the upper end of a first leg of the child;

cooperating hook and loop fastener means mounted on the first strap between the first loop and the second end of the first strap, and being engageable together to form a third, loop smaller than the second loop, for embracing a portion of the back supporting frame of the high chair to limit motion of the child's first leg away from the back supporting frame;

a one-piece, continuous, elongated second strap having a first end and a second end, and stitch means intermediate said ends forming a first loop in the second strap;

a pair or cooperating buckle elements mounted on the second strap, the buckle elements including a buckle tongue and a buckle housing for releasably receiving the tongue, one of said buckle elements having opening means receiving the first loop of the second strap, the other of said buckle elements being mounted on the second strap between the first loop and the first end of the second strap, the buckle tongue being engageable with the buckle housing to form a second loop in the second strap for embracing the upper end of the second leg of the child, and cooperating hook and loop fastener means mounted on the second strap between the first loop and the second end of the second strap, and being engageable together to form a third loop smaller than the second loop, for embracing a portion of the back supporting frame of the high chair to limit motion of the child's second leg away from the back supporting frame.

2. The combination comprising:

a child's high chair having a back supporting frame and a seat for supporting a child having a first leg and a second leg;

a one-piece, continuous elongated first strap having a first end and a second end, and stitch means intermediate said ends forming a first loop in the first strap;

a pair of cooperating buckle elements mounted on the first strap, the buckle elements including a buckle tongue, and a buckle housing for releasably receiving the tongue, one of said buckle elements having opening means receiving the first strap loop, the other of said buckle elements being mounted on the first strap between the first loop and the first end of the first strap, the buckle tongue being engageable with the buckle housing to form a second loop in the first strap for embracing the upper end of a first leg of the child;

cooperating hook and loop fastener means mounted on the first strap between the first loop and the second end of the first strap, and being engageable together to form a third loop smaller than the second loop, for embracing a portion of the back supporting frame of the high chair to limit motion of the child's first leg away from the back supporting frame;

a one-piece, continuous, elongated second strap having a first end and a second end, and stitch means intermediate said ends forming a first loop in the second strap;

a pair of cooperating buckle elements mounted on the second strap, the buckle elements including a buckle tongue and a buckle housing for releasably receiving the tongue, one of said buckle elements having opening means receiving the first loop of the second strap, the other of said buckle elements being mounted on the second strap between the first loop and the first end of the second strap, the buckle tongue being engageable with the buckle housing to form a second loop in the second strap for embracing the upper end of the second leg of the child; and cooperating hook and loop fastener means mounted on the second strap between the first loop and the second end of the second strap, and being engageable together to form a third loop smaller than the second loop, for embracing a portion of the back supporting frame of the high chair to limit motion of the child's second leg away from the back supporting frame.

* * * * *